US006368212B1

(12) United States Patent
Moody

(10) Patent No.: US 6,368,212 B1
(45) Date of Patent: Apr. 9, 2002

(54) FIVE CARD KENO

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 09/414,309

(22) Filed: Oct. 6, 1999

(51) Int. Cl.[7] ..... A63F 1/00
(52) U.S. Cl. ..... 463/13; 273/138.1; 273/274; 273/292
(58) Field of Search ..... 273/292, 138.1, 273/274; 463/13

(56) References Cited

U.S. PATENT DOCUMENTS

| | | | | |
|---|---|---|---|---|
| 1,527,929 A | * | 2/1925 | Simons | |
| 5,356,140 A | | 10/1994 | Dabrowski et al. | 273/85 CP |
| 5,531,440 A | | 7/1996 | Dabrowski et al. | 463/12 |
| 5,918,884 A | * | 7/1999 | DiMuro | |
| 6,149,156 A | * | 11/2000 | Feola | |
| 6,149,157 A | * | 11/2000 | Suan | |

OTHER PUBLICATIONS

Scarne's New Complete Guide to Gambling. by John Scarne, pp. 490–499, copyright 1974.

* cited by examiner

*Primary Examiner*—Benjamin H. Layno
*Assistant Examiner*—Vishu K. Mendiratta
(74) *Attorney, Agent, or Firm*—John Edward Roethel

(57) ABSTRACT

A fifty-two card deck of playing cards are displayed all face down. The player makes three separate wagers. A player selects five of the cards and the computer selects randomly five of the cards. All selected cards are turned face up. The poker hand ranking of the player's five cards is determined and the player is paid based on a pay table and the amount of the player's first wager if the player achieves a predetermined poker hand ranking on the player's five cards. The poker hand ranking of the computer's five cards is determined and the player is paid based on a pay table and the amount of the player's second wager if the player achieves a predetermined poker hand ranking on the computer's five cards. The player is also paid based multiples of the amount of the player's third wager based on the number of matches between the player's five cards and the computer's five cards. The method may also be practiced using two player's hands and two computer hands. Additionally, wild cards may be designated or added to the deck of cards. The pay tables are adjusted when wild cards are used. Alternatively, any matching cards may be designated as wild cards.

22 Claims, 5 Drawing Sheets

FIVE CARD KENO

This invention relates primarily to an electronic casino game, and more particularly to an electronic casino game that combines the features of a poker game with the features of a keno game.

BACKGROUND OF THE INVENTION

Keno is a well known game and has been played in gaming establishments for many years. In conventional keno, there are eighty numbers in the pool of numbers that may be drawn in any one round of the game. Twenty of the eighty keno balls are selected each game. Depending on the number of matches between the twenty numbers drawn and the numbered spots selected by the player, the player wins or loses. The more numbers that match, the higher the payoff to the player.

When the player plays an electronic video keno gaming machine, a single player plays against the keno gaming machine for each round of the game and the player either wins or loses each round. The player wagers a coin, token or credit and selects the amount of numbered spots that the player is attempting to match during that round of the game. All eighty numbers are displayed on a video screen with a 10×8 matrix similar to that of a keno ticket. The numbers are selected by the player using by a light pen, or by pressing the numbers on a selection panel or by touching the numbers selected using conventional touch screen technology.

In the typical electronic keno format, the player may select between one and ten numbered spots that the player is attempting to match. After the player has completed selecting the numbered spots that the player hopes to match and has made the appropriate wager, the player presses the "Start" button. This causes the electronic controls of the gaming machine to randomly select twenty numbers from the pool of eighty numbers and the selected numbers are displayed to the player. The electronic controls of the gaming machine determine whether the player has achieved a winning payout at the conclusion of each round of the game. Just as in live keno, the player wins when he matches all or a predetermined minimum number of his selected numbered spots. If the player matches less than the predetermined minimum number of his selected numbered spots, then the player loses his wager. Payouts are made by accruing credits on the credit meter of the gaming machine or dispensing coins or tokens into a payout tray.

The basic principles of the play of keno are set out in Scarne's New Complete Guide to Gambling, by John Scarne, at pages 490–499.

Poker has also been a popular wagering game for many years. The object of basic poker is for a player to achieve a five card hand with the highest possible poker hand ranking. The conventional poker hand rankings are a Royal Flush, a Straight Flush, a Four of a Kind, a Full House, a Flush, a Straight, a Three of a Kind, a Two Pair, a Pair of Jacks or Better and High Card in Hand. In Stud Poker, the player receives five cards and no replacement cards are permitted. The poker hand ranking of a player's stud poker hand is determined by the five cards received by the player.

In a typical electronic poker casino game, the awards made to the player are determined by a pay table. The pay table is established based on the number of coins, tokens or credits wagered by the player and the type of poker hand ranking that the player achieves.

Poker games also exist in which wild cards are used. Any of the cards in a conventional fifty-two card deck can be designated as wild cards with Deuces Wild being the most prevalent wild card used in electronic poker gaming machines. It is also known to add one or more Jokers to the conventional deck and the Jokers are used as wild cards. The pay table is modified to recognize the differing odds for achieving various poker hands when wild cards are involved. Furthermore, different poker hand rankings are used in the pay table to recognize different winning combinations that can be achieved using wild cards, such as Five-of-a-Kind and a Wild Royal Flush.

Both electronic poker games and electronic keno games are very popular in gaming establishments. Players enjoy the thrill and excitement of playing these games which also offer the opportunity of winning a large return for a nominally small wager. Both electronic poker games and electronic keno games add a level of skill to the play of the games as opposed to the mindless skill level required for the pull of a slot machine handle.

There is a need in the casino industry to develop new and creative games to continue to pique the curiosity and interest of the player. The best new games are those that build on the familiarity of players with the types of games that they have played before. It is also desirable to provide games that allow the player to make multiple wagers so as to offer the player the opportunity for large payouts while at the same time increasing the revenue generated to the gaming establishment.

It is an object of the present invention to provide an improved casino game in either an electronic game format or a live game format.

It is a feature of the present invention to provide a casino game that combines the features of poker and keno. The player makes three separate wagers. The player selects a first five card stud poker hand and the player receives a first payout if this first five card stud poker achieves a predesignated poker hand ranking. The gaming machine also randomly selects a second five card stud poker hand and the player receives a second payout if this second five card stud poker hand achieves a predesignated poker hand ranking. Finally, the player receives a third payout depending on the number of matches between the cards of the first hand and the second hand.

It is an advantage of the present invention that the player makes three separate wagers and can win payouts on either a first event, a second event or a third event. The gaming establishment will achieve increased gaming revenues while the player will have the opportunity to win large, multiple payouts.

Other objects, features and advantages of the present invention will become apparent from a consideration of the following detailed description.

SUMMARY OF THE INVENTION

A fifty-two card deck of playing cards are displayed all face down. The player makes three separate wagers. A player selects five of the cards and the computer selects randomly five of the cards. All selected cards are turned face up. The poker hand ranking of the player's five cards is determined and the player is paid based on a pay table and the amount of the player's first wager if the player achieves a predetermined poker hand ranking on the player's five cards. The poker hand ranking of the computer's five cards is determined and the player is paid based on a pay table and the amount of the player's second wager if the player achieves a predetermined poker hand ranking on the computer's five cards. The player is also paid various multiples of the amount of the player's third wager based on the number of matches between the player's five cards and the computer's five cards.

The method may also be practiced using two player's hands and two computer hands. Additionally, wild cards may be designated or added to the deck of cards. The pay tables are adjusted when wild cards are used. Alternatively, any matching cards may be designated as wild cards.

DETAILED DESCRIPTION OF THE PREFERRED EMBODIMENTS

Figure 1:
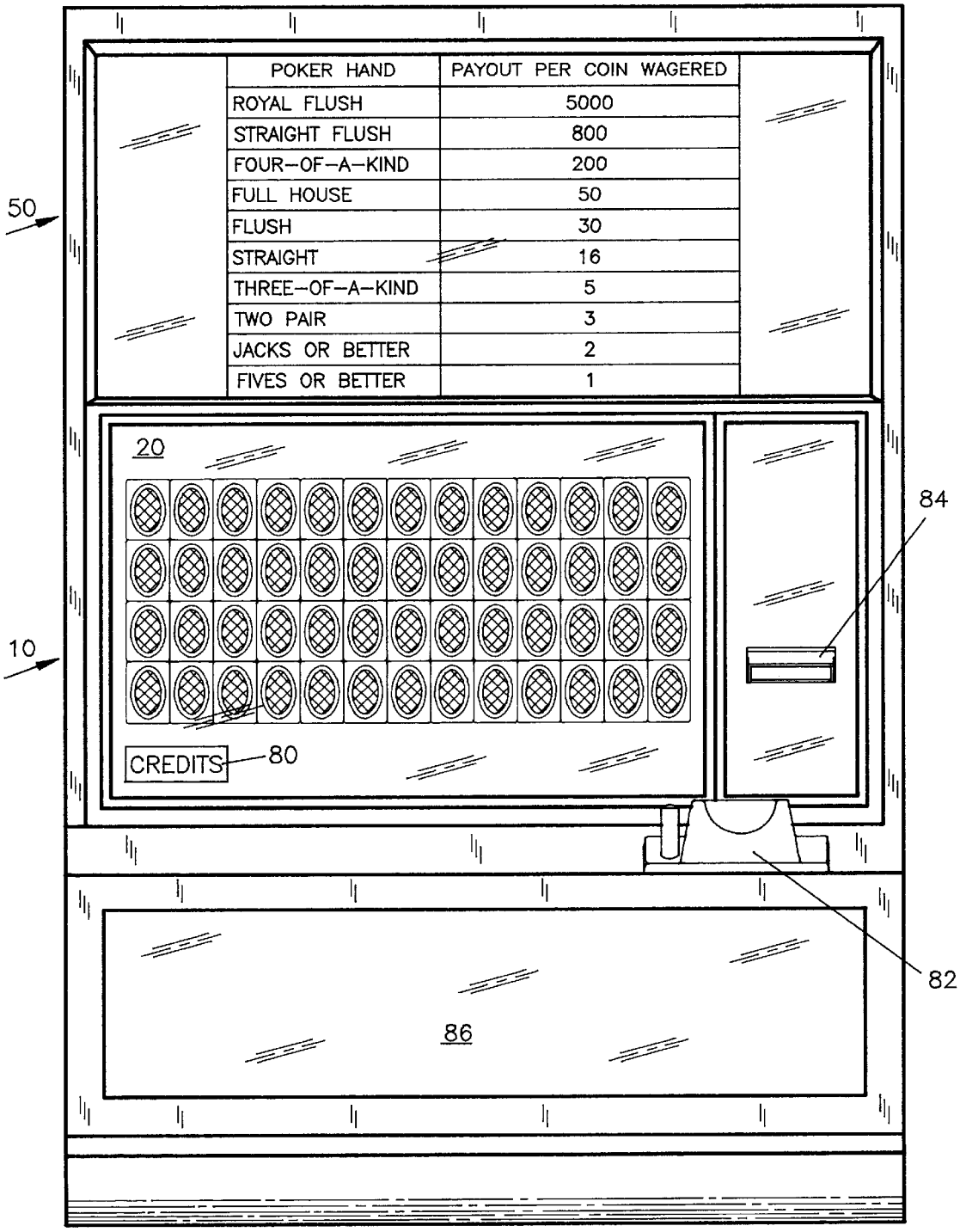
FIG. 1 shows a representation of an electronic gaming machine that can be used in the method of the present invention.

The method of the present invention is played using an electronic gaming machine. The description that follows refers to an electronic gaming machine, but the same principles of the present invention can be easily adapted to a live game format.

An electronic gaming machine 10 is provided with a video screen display 20, a coin head 82 for receiving coins or gaming tokens, a bill acceptor 84 for receiving paper currency, a coin hopper (not shown and mounted on the interior of the gaming machine cabinet) for making payouts into a payout tray 86, a pay table 50 which can be displayed on the gaming glass or on the video screen display and computer controls (not shown) to operate the gaming machine. The computer controls are conventionally a motherboard mounted in the interior of the gaming machine cabinet and the motherboard has mounted thereon the computer chips programmed to operate the gaming machine, as is conventional. Also provided are various buttons (not shown) that allow the player to make wagers, start the play of the game and collect winnings. Alternatively, conventional touch screen technology may be used to allow the player to operate the gaming machine 10 by pressing locations provided on the video screen display 20. Each of these elements are conventional in electronic gaming machines.

The video screen display 20 shows a 13×4 matrix of the fifty-two positions which represents a conventional deck of playing cards that comprises the pool of objects which are used in the method of play of the present invention. While the video screen display 20 in the figures shows the arrangement of cards as a 13×4 matrix, any suitable configuration or layout of the cards can be used.

The preferred embodiment of the present invention is a game to be called Five Card Keno. In order to start a round of this game, a player makes three separate wagers. Wagering is accomplished by the player inserting coins or tokens into the coin head 82 or by inserting paper currency into the bill acceptor 84, as is conventional. When paper currency is inserted into a bill acceptor 84, the value of the paper currency is allocated as credits on a credit meter 80 shown on the video screen display 20 as is conventional. Also as is conventional, the player may also wager by playing any accrued credits that the player has on his credit meter 80.

The player's first wager is allocated to the first stud poker hand portion of the game which is the player's stud poker hand. The player's second wager is allocated to the second stud poker hand portion of the game which is the computer's stud poker hand. The player's third wager is allocated to the matching cards portion of the game. The player may wager any amount on each of three wagers up to the maximum permitted by the configuration of the gaming machine. In the preferred embodiment of the present invention, the player would be allowed to wager a maximum of five coins, tokens or credits on each of the three wagers.

Figure 2:
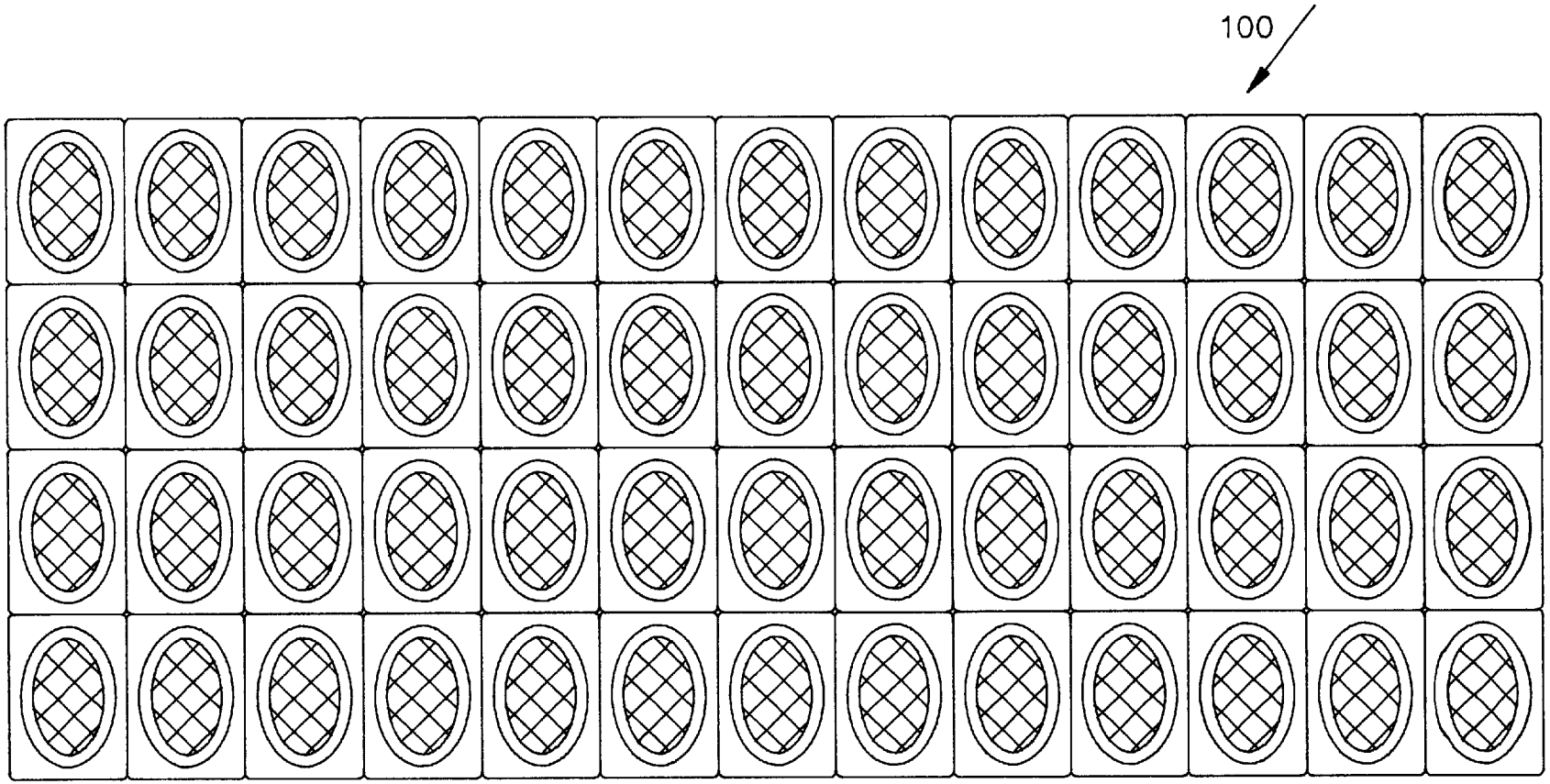
FIG. 2 shows the video screen display before the player has selected his five cards.
Figure 3:
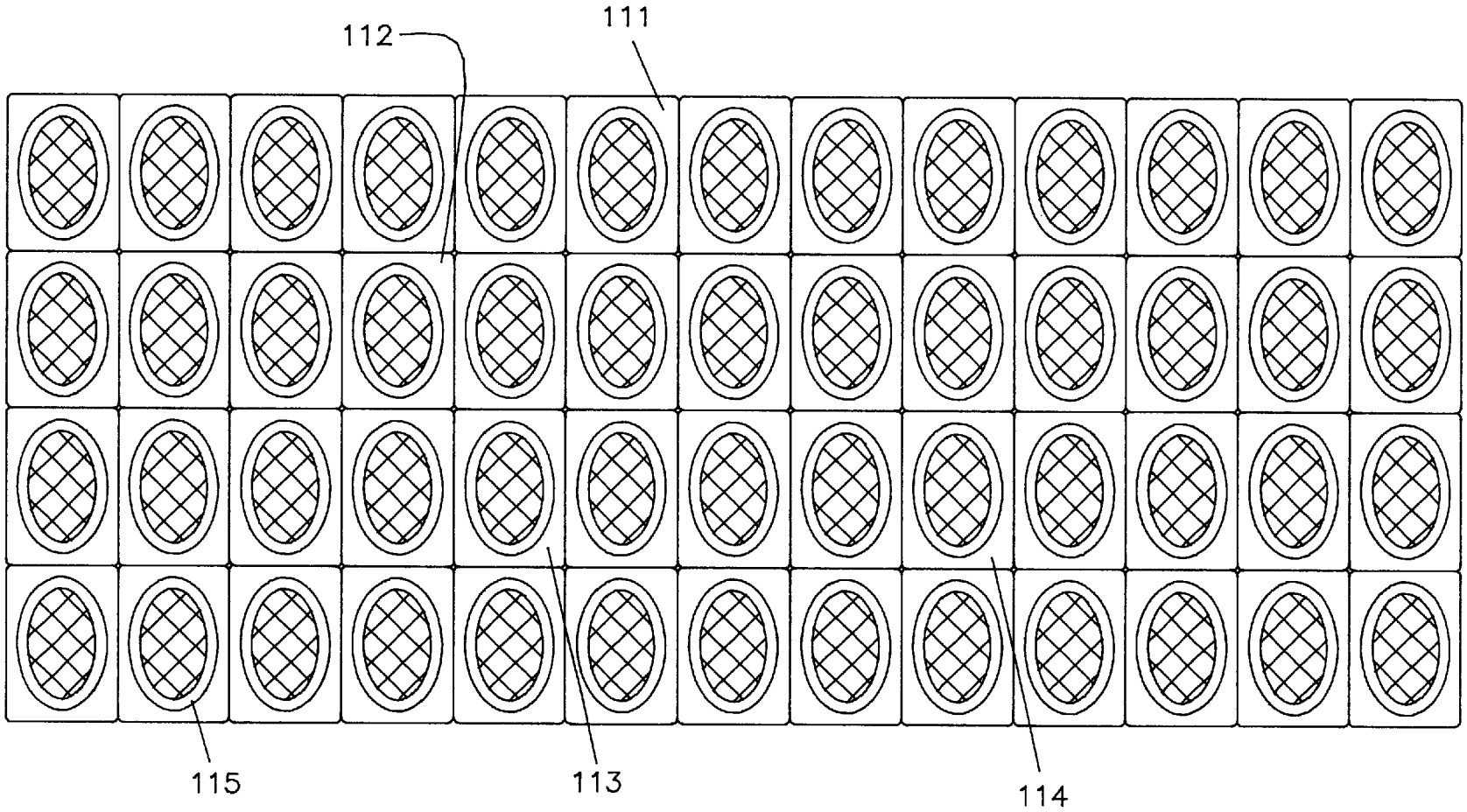
FIG. 3 shows the video screen display after the player has selected his five cards.
Figure 4:
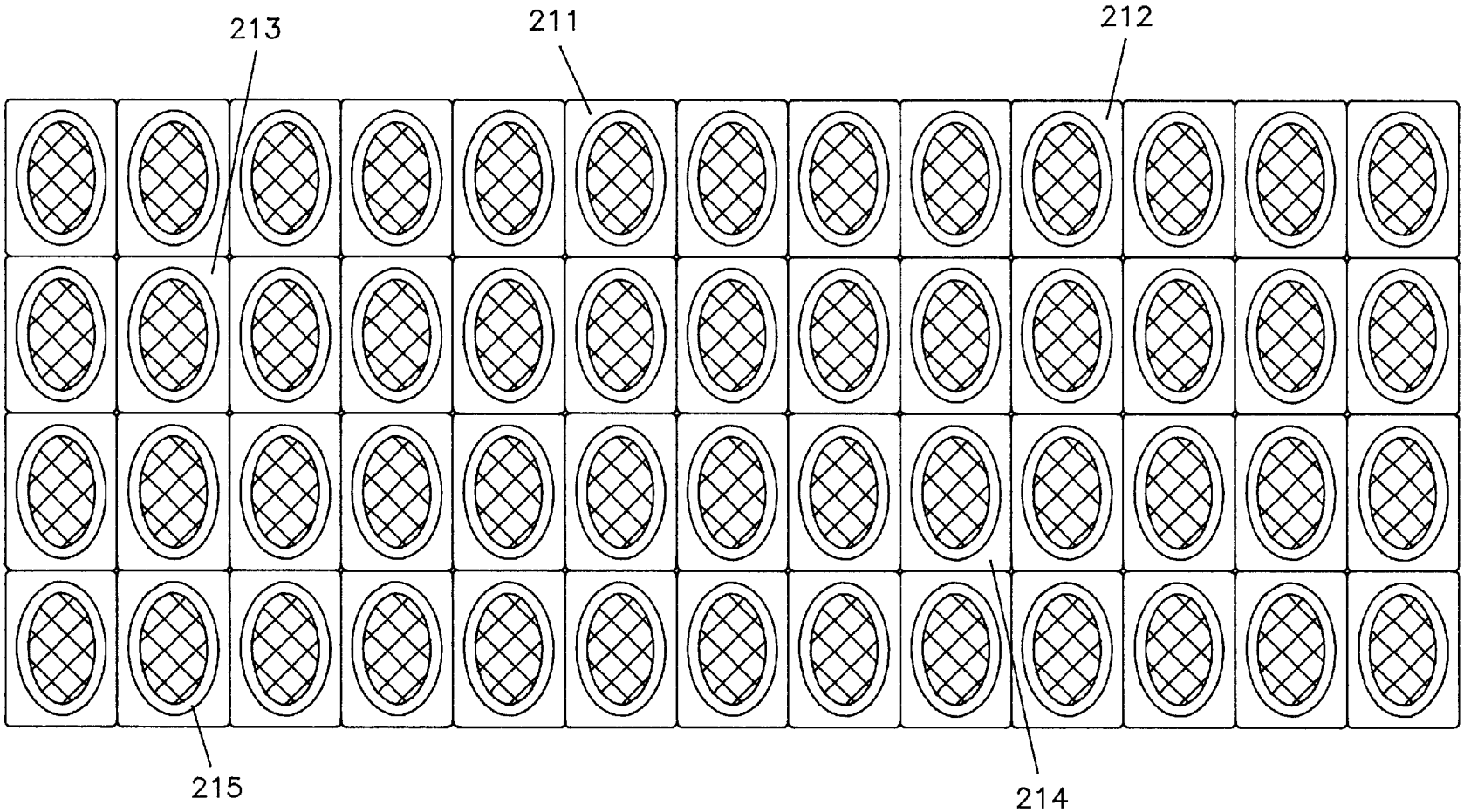
FIG. 4 shows the video screen display after the gaming machine has randomly selected its five cards.

The method of play is depicted in FIGS. 2–4. As shown in FIG. 2, after the player has made his wagers, the initial video screen display 100 shows all fifty-two cards in the face down condition which is represented by card backs. At the beginning of each round of the game, the electronic computer controls randomly distribute each card of the fifty-two card deck among the fifty-two card positions shown in FIG. 2. Thus, the order of the cards changes for each round by means of this electronic shuffle.

After the player has completed his wagering, the player then selects five cards from the video screen display representing the first stud poker hand. The player makes this selection by using a light pen or touch screen technology or any other suitable manner of allowing the player to select five of the card positions that are shown face down on the screen display. Any suitable display can be used to show which positions the player has selected as the first stud poker hand, such as having each position change to a another color on the video screen display. For example, FIG. 3 shows the five face down cards selected by the player 111, 112, 113, 114 and 115.

After the player has completed his selection of five positions, the player then presses a "DEAL" button. The computer controls then randomly select five positions on the video screen display and the computer selected five positions represent the second five card stud poker hand. Again any suitable display can be used to show which positions the computer controls have selected as the second stud poker hand, such as having each position change to another color on the video screen display, preferably a different color than the color used to show the five positions selected by the player. As shown in FIG. 4, the computer has randomly selected the five cards 211, 212, 213, 214 and 215.

All of the selected positions of both the first five card stud poker hand and the second five card stud poker hand are then turned face up to reveal which cards of the fifty-two card deck have been selected.

Figure 5:
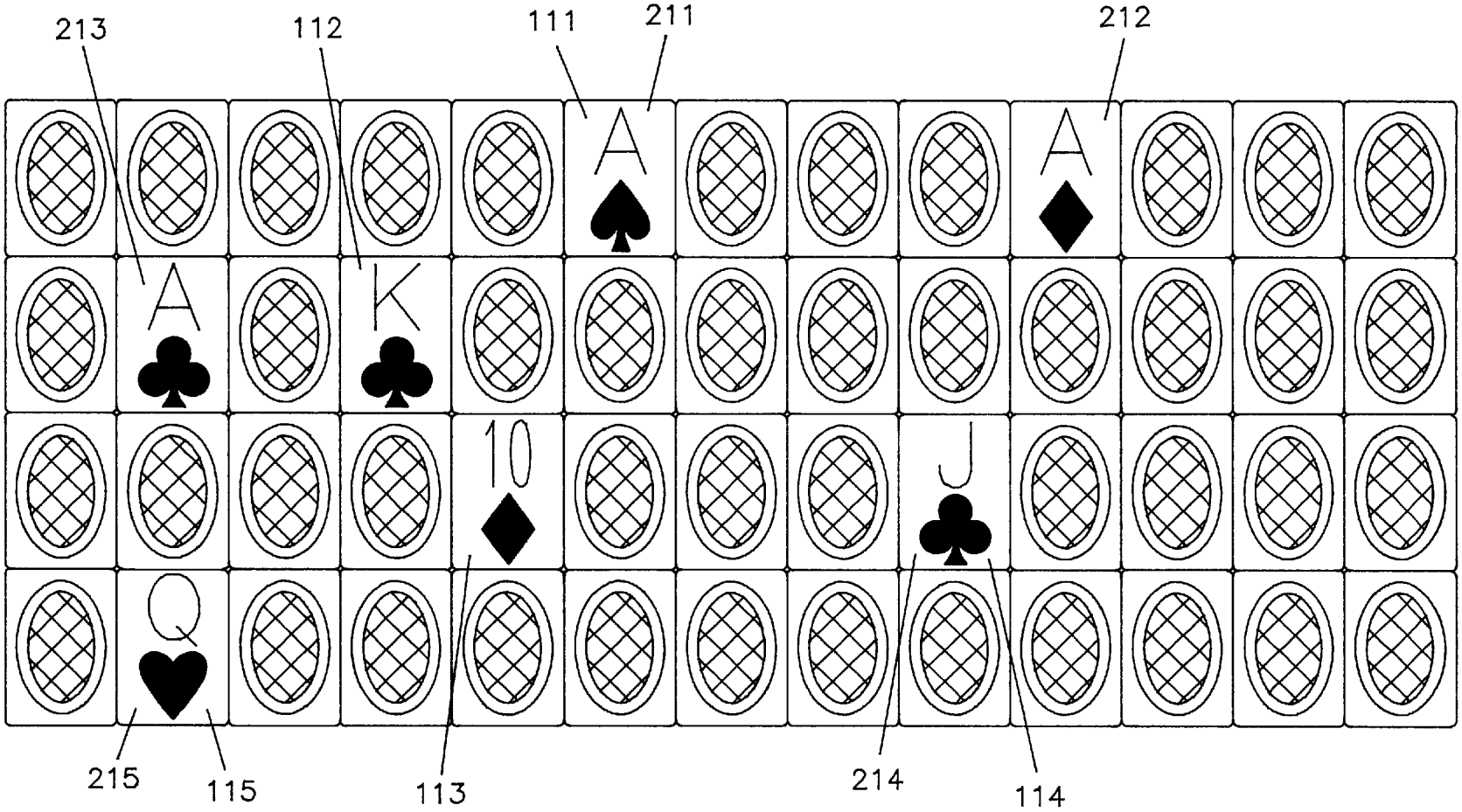
FIG. 5 shows the video screen display after the results of the play of the game have been revealed.

FIG. 5 shows as an example the results of a play of a round of the game. The five positions selected by the player and representing the first five card stud poker hand are: the Ace of Spades 111, the King of Clubs 112, the Ten of Diamonds 113, the Jack of Clubs 114 and the Queen of Hearts 115.

FIG. 5 also shows as an example the five positions selected by the computer controls and representing the second five card stud poker hand: the Ace of Spades 211, the Ace of Diamonds 212, the Ace of Clubs 213, the Jack of Clubs 214 and the Queen of Hearts 215.

Winning and losing wagers are now determined. With regard to the first wager, the poker hand ranking of the first five card stud poker hand is determined. In the example shown in the drawings, the first hand has a poker hand ranking of a Straight. With regard to the second wager, the poker hand ranking of the second five card stud poker hand is determined. In the example shown in the drawings, the second hand has a poker hand ranking of a Three-of-a-Kind.

The payouts for each of these poker hand rankings is established in a pay table. In the preferred embodiment of the present invention, a pay table such as the one shown in Table 1 can be used.

TABLE 1

| POKER HAND | PAYOUT PER COIN WAGERED |
|---|---|
| ROYAL FLUSH | 5000 |
| STRAIGHT FLUSH | 800 |
| FOUR OF A KIND | 200 |
| FULL HOUSE | 50 |
| FLUSH | 30 |
| STRAIGHT | 16 |
| THREE-OF-A-KIND | 5 |
| TWO PAIR | 3 |
| JACKS OR BETTER | 2 |
| FIVES OR BETTER | 1 |

Any suitable poker ranking pay table can be used based on the mathematical odds which the gaming establishment wishes to offer to the player. Using the pay table shown in Table 1 with the example given above, if the player had wagered five credits on the first hand, the player would win 80 credits for the Straight. If the player had wagered five credits on the second hand, the player would win 25 credits for the Three-of-a-Kind.

With regard to the matching cards portion of the game, the player is paid depending on the number of matches between the card positions selected by the player and the card positions selected by the computer controls. Any suitable payout scheme may be used for this matching cards portion of the game, but in the preferred embodiment, the player is paid a multiple of his third wager based on the number of matches achieved. For example, Table 2 shows a suitable pay table for the matching cards portion of the game.

TABLE 2

| NUMBER OF MATCHES | PAYOUT PER COIN WAGERED |
|---|---|
| FIVE MATCHES | 100 |
| FOUR MATCHES | 25 |
| THREE MATCHES | 12 |
| TWO MATCHES | 4 |
| ONE MATCH | 2 |

With reference to FIG. 5, in this example, the player has matched three cards from the first hand with three cards from the computer selected second hand. Thus, the player would win twelve times the amount of his third wager for achieving three matches. For example, if the player's third wager was five credits, the player would win 60 credits on this matching cards portion of the game.

Any suitable matching cards pay table can be used based on the mathematical odds which the gaming establishment wishes to offer to the player.

A different betting scheme may be used with this method of play. Instead of having the player make three separate wagers, the player may make a single wager of one or more credits. If the player achieves a winning card combination on the first hand, then the player receives a first payout based on the total amount of his wager. Likewise, if the player achieves a winning card combination on the second hand, then the player receives a second payout also based on the total amount of his wager. If the player achieves a winning number of card matches on the matching card portion of the game, then the player receives a third payout. This third payout can be based on either the total amount of the player's wager, the payout received by the player on the first hand, the payout received by the player on the second hand or combinations of any of these. In this modified betting and payout scheme, the actual payout amounts shown in Table 1 and Table 2 would also be modified.

Other variations of the present invention may be utilized. For example, using the same video screen display 100, the player may play multiple variations of the main method of play. One such variation can be called Ten Card Keno and the player makes five wagers to participate in a round of the game.

The player's first two wagers, A and A', are allocated to the first two stud poker hands, X and X', portion of the game. The player's second two wagers, B and B', are allocated to the second two stud poker hands, Y and Y', portion of the game. The player's fifth wager C is allocated to the matching cards portion of the game. The player may wager any amount on each of these wagers up to the maximum permitted by the configuration of the gaming machine. In the preferred embodiment of the present invention, the player would be allowed to wager a maximum of ten coins, tokens or credits on each of the these wagers for a total of fifty credits to be played on a single round of the game.

The game proceeds in a manner similar to Five Card Keno. After the player has made his five wagers, the initial video screen display 100 shows all fifty-two cards in the face down condition which is represented by card backs. At the beginning of each round of the game, the electronic computer controls randomly distribute each card of the fifty-two card deck among the fifty-two card positions.

After the player has completed his wagering, the player then selects five cards from the video screen display representing the first player's stud poker hand X and five other cards representing the second player's stud poker hand X'. These two separate five card hands can be indicated by using different colors for each hand, or any other suitable manner of displaying the two hands differently.

After the player has completed his selection of the player's two stud poker hands, the player then presses the "DEAL" button. The computer controls then randomly select two groups of five positions on the video screen display, one group representing the first computer stud poker hand B and the second group representing the second computer stud poker hand B'. Again any suitable display can be used to show which positions the computer controls have selected as the first computer stud poker hand and the second computer stud poker hand, such as having each position change to other colors on the video screen display, preferably different colors than the colors used to show the two player's stud poker hands.

All of the selected positions of the player's first and second card stud poker hands and the computer's first and second stud poker hands are then turned face up to reveal which cards of the fifty-two card deck have been selected.

Winning and losing wagers are now determined relative to each of the five card stud poker hands. The payouts for each of these poker hand rankings is established in a pay table. In the preferred embodiment of the present invention, a pay table such as the one shown in Table 3 can be used.

TABLE 3

| POKER HAND | PAYOUT PER COIN WAGERED |
|---|---|
| ROYAL FLUSH | 5000 |
| STRAIGHT FLUSH | 800 |
| FOUR OF A KIND | 200 |
| FULL HOUSE | 50 |
| FLUSH | 30 |
| STRAIGHT | 16 |
| THREE-OF-A-KIND | 5 |
| TWO PAIR | 3 |
| JACKS OR BETTER | 2 |
| FIVES OR BETTER | 1 |

Any suitable poker ranking pay table can be used based on the mathematical odds which the gaming establishment wishes to offer to the player.

With regard to the matching cards portion of the game, the player is paid depending on the number of matches between the ten card positions selected by the player and the ten card positions selected by the computer controls. Any suitable payout scheme may be used for this matching cards portion of the game, but in the preferred embodiment, the player is paid a multiple of his combined third wagers based on the number of matches achieved. For example, Table 4 shows a suitable pay table for the matching cards portion of the game.

TABLE 4

| NUMBER OF MATCHES | PAYOUT PER COIN WAGERED |
|---|---|
| TEN MATCHES | 10000 |
| NINE MATCHES | 1000 |
| EIGHT MATCHES | 500 |
| SEVEN MATCHES | 100 |
| SIX MATCHES | 50 |
| FIVE MATCHES | 25 |
| FOUR MATCHES | 10 |
| THREE MATCHES | 3 |
| TWO MATCHES | 2 |
| ONE MATCH | 1 |

Other matching schemes may be used instead of ten on ten matching scheme. For example, a five on five matching scheme may be used. The five cards of the player's hand A may be matched to the five cards of the computer's hand B and the five cards of the player's hand A' may be matched to the five cards of the computer's hand B'. Or hand A may be matched to hand B' and hand A' matched to hand B. Or hand A may be matched to both hand B and hand B' and hand A' may be matched to both hand B and hand B'. When a five on five matching scheme is used, a different pay table would also be used. In order to accommodate these various matching schemes, the player's fifth wager can be allocated among the various matching possibilities that are provided.

The alternative betting scheme discussed above in connection with Five Card Keno may also be applied to this Ten Card Keno variation.

Other variations may be made to the method of play of the present invention. In either Five Card Keno or Ten Card Keno, one or more Jokers may be added to the pool of cards and the Jokers may be used as wild cards in the stud poker hands. Alternatively, certain cards may be predesignated as wild cards, such as Deuces Wild. In either of these instances, the pay table for the poker hand rankings will be adjusted to compensate for the different mathematical probabilities of various poker hand rankings being achieved since wild cards are included. In addition, the pay table will be adjusted to reflect that certain poker hand rankings, such as a Five-of-a-Kind and a Wild Royal Flush, can be achieved when wild cards are used.

Progressive jackpots may be included in the pay tables of the method of play of the present invention. A progressive jackpot may be used if either a player's stud poker hand or the computer's stud poker hand results in a Royal Flush. A very large progressive jackpot may also be used for the rare instance when the player's five selected positions are the same as the computer's five selected positions and a Royal Flush is achieved.

Another variation that may be made to either Five Card Keno or Ten Card Keno can be called Wild Card Keno. In this variation, the cards in the positions that are matched during the draw of the player's hand and the computer's hand are treated as wild cards. The pay table for the poker hand rankings will be adjusted to compensate for the different mathematical probabilities of various poker hand rankings being achieved since wild cards are included. In addition, the pay table will be adjusted to reflect that certain poker hand rankings, such as a Five-of-a-Kind and a Wild Royal Flush, can be achieved when wild cards are used.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a casino game that uses poker hand ranking and also uses matches between a player's hand and a computer's hand comprising the following steps:

a) a player making a first wager on a player's stud hand, a second wager on a computer stud hand and a third wager on the number of matches between the player's stud hand and the computer's stud hand, b) providing a display of playing cards all face down;

c) a player selecting five cards from the display as the player's stud hand;

d) the computer selecting five cards from the display as the computer's stud hand;

e) paying the player a first award based on the poker hand ranking of the player's stud hand;

f) paying the player a second award based on the poker hand ranking of the computer's stud hand;

g) paying the player a third award based on the number of matches between the player's stud hand and the computer's stud hand.

2. The method of claim 1 in which the first award is based on the amount of the player's first wager and the second award is based on the amount of the player's second wager.

3. The method of claim 1 in which the first award and the second award are based on a pay table.

4. The method of claim 3 in which the amount paid to the player is according to the following pay table:

| POKER HAND | PAYOUT PER COIN WAGERED |
|---|---|
| ROYAL FLUSH | 5000 |
| STRAIGHT FLUSH | 800 |
| FOUR OF A KIND | 200 |
| FULL HOUSE | 50 |

-continued

| POKER HAND | PAYOUT PER COIN WAGERED |
|---|---|
| FLUSH | 30 |
| STRAIGHT | 16 |
| THREE-OF-A-KIND | 5 |
| TWO PAIR | 3 |
| JACKS OR BETTER | 2 |
| FIVES OR BETTER | 1. |

5. The method of claim 1 in which the third award is a multiple of the amount of the player's third wager.

6. The method of claim 5 in which the multiple paid to the player is according to the following pay table:

| NUMBER OF MATCHES | PAYOUT PER COIN WAGERED |
|---|---|
| FIVE MATCHES | 100 |
| FOUR MATCHES | 25 |
| THREE MATCHES | 12 |
| TWO MATCHES | 4 |
| ONE MATCH | 2. |

7. A method of playing a casino game that uses poker hand ranking and also uses matches between a player's hand and a computer's hand comprising the following steps:

a) a player making a first wager on a first player's stud hand, a second wager on a second player's stud hand, a third wager on a first computer stud hand, a fourth wager on a second computer stud hand and a fifth wager on the number of matches between the player's combined first and second stud hands and the computer's combined first and second stud hand, b) providing a display of playing cards all face down;

c) a player selecting five cards from the display as the player's first stud hand and the player selecting five cards as the player's second stud hand;

d) the computer selecting five cards from the display as the computer's first stud hand and the computer selecting five cards as the computer's second stud hand;

e) paying the player a first award based on the poker hand ranking of the player's first stud hand and paying the player a second award based on the poker hand ranking of the player's second stud hand;

f) paying the player a third award based on the poker hand ranking of the computer's first stud hand and paying the player a fourth award based on the poker hand ranking of the computer's second stud hand;

g) paying the player a fifth award based on the number of matches between the player's combined first and second stud hands and the computer's combined first and second stud hand.

8. The method of claim 7 in which the first award is based on the amount of the player's first wager, the second award is based on the amount of the player's second wager, the third award is based on the amount of the player's third wager and the fourth award is based on the amount of the player's fourth wager.

9. The method of claim 7 in which the first award, second award, third award and the fourth award are based on a pay table.

10. The method of claim 9 in which the amount paid to the player is according to the following pay table:

| POKER HAND | PAYOUT PER COIN WAGERED |
|---|---|
| ROYAL FLUSH | 5000 |
| STRAIGHT FLUSH | 800 |
| FOUR OF A KIND | 200 |
| FULL HOUSE | 50 |
| FLUSH | 30 |
| STRAIGHT | 16 |
| THREE-OF-A-KIND | 5 |
| TWO PAIR | 3 |
| JACKS OR BETTER | 2 |
| FIVES OR BETTER | 1. |

11. The method of claim 7 in which the fifth award is a multiple of the amount of the player's fifth wager.

12. The method of claim 11 in which the multiple paid to the player is according to the following pay table:

| NUMBER OF MATCHES | PAYOUT PER COIN WAGERED |
|---|---|
| TEN MATCHES | 10000 |
| NINE MATCHES | 1000 |
| EIGHT MATCHES | 500 |
| SEVEN MATCHES | 100 |
| SIX MATCHES | 50 |
| FIVE MATCHES | 25 |
| FOUR MATCHES | 10 |
| THREE MATCHES | 3 |
| TWO MATCHES | 2 |
| ONE MATCH | 1. |

13. A method of playing a casino game that uses poker hand ranking and also uses matches between a player's hand and a computer's hand comprising the following steps:

a) a player making a first wager on a first player's stud hand, a second wager on a second player's stud hand, a third wager on a first computer stud hand, a fourth wager on a second computer stud hand and a fifth wager on the number of matches between the player's hands and the computer's hands, b) providing a display of playing cards all face down;

c) a player selecting five cards from the display as the player's first stud hand and the player selecting five cards as the player's second stud hand;

d) the computer selecting five cards from the display as the computer's first stud hand and the computer selecting five cards as the computer's second stud hand;

e) paying the player a first award based on the poker hand ranking of the player's first stud hand and paying the player a second award based on the poker hand ranking of the player's second stud hand;

f) paying the player a third award based on the poker hand ranking of the computer's first stud hand and paying the player a fourth award based on the poker hand ranking of the computer's second stud hand;

g) paying the player a fifth award based on the number of matches between the player's hands and the computer's hands.

14. The method of claim 13 in which the first award is based on the amount of the player's first wager, the second award is based on the amount of the player's second wager, the third award is based on the amount of the player's third wager and the fourth award is based on the amount of the player's fourth wager.

15. The method of claim 13 in which the first award, second award, third award and the fourth award are based on a pay table.

16. The method of claim 15 in which the amount paid to the player is according to the following pay table:

| POKER HAND | PAYOUT PER COIN WAGERED |
|---|---|
| ROYAL FLUSH | 5000 |
| STRAIGHT FLUSH | 800 |
| FOUR OF A KIND | 200 |
| FULL HOUSE | 50 |
| FLUSH | 30 |
| STRAIGHT | 16 |
| THREE-OF-A-KIND | 5 |
| TWO PAIR | 3 |
| JACKS OR BETTER | 2 |
| FIVES OR BETTER | 1. |

17. The method of claim 13 in which the fifth award is a multiple of the amount of the player's fifth wager.

18. The method of claim 13 in which the amount of the fifth award is based on the number of matches between the player's first hand and the computer's first hand.

19. The method of claim 13 in which the amount of the fifth award is based on the number of matches between the player's first hand and the computer's second hand.

20. The method of claim 13 in which the amount of the fifth award is based on the number of matches between the player's second hand and the computer's first hand.

21. The method of claim 13 in which the amount of the fifth award is based on the number of matches between the player's second hand and the computer's second hand.

22. A method of playing a casino game that uses poker hand ranking and also uses matches between a player's hand and a computer's hand comprising the following steps:

a) a player making a first wager on a player's stud hand, a second wager on a computer stud hand and a third wager on the number of matches between the player's stud hand and the computer's stud hand, b) providing a display of playing cards all face down;

c) a player selecting five cards from the display as the player's stud hand;

d) the computer selecting five cards from the display as the computer's stud hand;

e) designating as wild cards any cards that have been selected as common cards between the player's stud hand and the computer's stud hand;

f) paying the player a first award based on the poker hand ranking of the player's stud hand including any cards that have been designated as wild cards;

g) paying the player a second award based on the poker hand ranking of the computer's stud hand including any cards that have been designated as wild cards;

h) paying the player a third award based on the number of matches between the player's stud hand and the computer's stud hand.

* * * * *